US010760843B2

(12) United States Patent
Schoonen

(10) Patent No.: US 10,760,843 B2
(45) **Date of Patent: *Sep. 1, 2020**

(54) DEVICE AND A METHOD FOR MAKING ICE CUBES AND A METERING DEVICE FOR ICE CUBES

(71) Applicant: W. SCHOONEN BEHEER B.V., TM Nuenen (NL)

(72) Inventor: Wilhelmus Franciskus Schoonen, Nuenen (NL)

(73) Assignee: W. SCHOONEN BEHEER B.V., Nuenen (NL)

( * ) Notice: Subject to any disclaimer, the term of this patent is extended or adjusted under 35 U.S.C. 154(b) by 78 days.

This patent is subject to a terminal disclaimer.

(21) Appl. No.: 15/143,943

(22) Filed: May 2, 2016

(65) Prior Publication Data

US 2017/0051962 A1 Feb. 23, 2017

Related U.S. Application Data

(63) Continuation of application No. 12/666,581, filed as application No. PCT/NL2008/000166 on Jul. 1, 2008, now Pat. No. 9,328,950.

(30) Foreign Application Priority Data

Jul. 2, 2007 (NL) ..... 1034074

(51) Int. Cl.
*F25C 1/22* (2018.01)
*F25C 1/06* (2006.01)
(Continued)

(52) U.S. Cl.
CPC ..... *F25C 1/06* (2013.01); *F25C 1/20* (2013.01); *F25C 5/08* (2013.01); *F25C 5/20* (2018.01)

(58) Field of Classification Search
CPC .... F25C 1/06; F25C 1/225; F25C 1/22; F25C 5/08; F25C 5/04; F25C 1/12
(Continued)

(56) References Cited

U.S. PATENT DOCUMENTS 4,845,955 A * 7/1989 Taylor ..... F25C 5/04 62/345
5,924,301 A * 7/1999 Cook ..... F25C 5/10 62/347

(Continued)

*Primary Examiner* — Jonathan Bradford
(74) *Attorney, Agent, or Firm* — Leydig, Voit & Mayer, Ltd.

(57) ABSTRACT

Device and method for making ice cubes, comprising a supplying device for supplying a liquid substance to at least one elongated mould (1) and a refrigerating device for freezing said liquid substance, which at least one mould defines a space for an ice column which is at least substantially closed at least while said liquid substance is being refrigerated. The at least one mould comprises two mould halves (1*a*, 1*b*) which are movable relative to each other, so that the mould halves can be moved apart once the ice column has been formed. Method for making ice cubes, comprising the steps of a) supplying a liquid substance to a mould, b) freezing the liquid substance in the mould, and c) removing the ice cubes thus formed from the mould, wherein the liquid substance is supplied in step a) to a mould comprising an at least substantially closed space. Metering device for ice cubes.

14 Claims, 3 Drawing Sheets

(51) Int. Cl.

| | |
|---|---|
| ***F25C 1/20*** | (2006.01) |
| *F25C 5/20* | (2018.01) |
| *F25C 5/08* | (2006.01) |

(58) Field of Classification Search
USPC ..... 62/340, 349, 71
See application file for complete search history.

(56) References Cited

U.S. PATENT DOCUMENTS

| | | | | |
|---|---|---|---|---|
| 6,434,965 | B1 * | 8/2002 | Hughes | A23L 3/364 62/352 |
| 6,508,075 | B1 * | 1/2003 | Shipley | F25C 1/06 62/347 |
| 6,574,974 | B1 * | 6/2003 | Herzog | F25C 1/04 137/351 |
| 6,857,277 | B2 * | 2/2005 | Somura | F25C 1/18 249/92 |
| 6,993,929 | B1 * | 2/2006 | Funk | F25C 1/12 62/347 |
| 2004/0025527 | A1 * | 2/2004 | Takahashi | F25C 1/18 62/340 |
| 2004/0093878 | A1 * | 5/2004 | Sanuki | F25C 1/12 62/135 |
| 2006/0032263 | A1 * | 2/2006 | Sanuki | F25C 1/12 62/340 |

* cited by examiner

DEVICE AND A METHOD FOR MAKING ICE CUBES AND A METERING DEVICE FOR ICE CUBES

CROSS-REFERENCE TO RELATED APPLICATIONS

This application is a continuation application of U.S. application Ser. No. 12/666,581, filed Dec. 23, 2009, which claims priority to International Application No. PCT/NL2008/000166, filed Jul. 1, 2008, which claims priority to The Netherlands Application No. 1034074, filed Jul. 2, 2007, which are all expressly incorporated by reference in their entirety, including any references contained therein.

The present invention, according to a first aspect thereof, relates to a device for making ice cubes, comprising a supplying device for supplying a liquid substance to at least one elongated mould and a refrigerating device for freezing said liquid substance, which at least one mould defines a space for an ice column which is at least substantially closed at least while said liquid substance is being refrigerated. The term "ice" as used herein refers to a frozen substance. The term is not limited only to frozen water or a frozen liquid, but it also encompasses frozen liquid substances such as foodstuffs, for example a puree. For the sake of briefness, the term "ice" is used herein to indicate the collection of frozen substances.

U.S. Pat. No. 2,900,803 A describes a refrigerator which is fitted with such a device in the door thereof. The refrigerator door comprises a housing with four tubes. The housing is surrounded by a continuous freezing coil, which is in contact with the housing wall. The tubes can be filled with water from above, which water can be removed from the tubes, at the bottom side thereof, in the form of ice after being frozen. Although said device is suitable for use in a refrigerator, it is not suitable for making relatively large amounts of ice cubes.

Consequently it is an object of the present invention, according to the first aspect thereof, to provide a device as referred to in the introduction, by means of which ice cubes can be made on a larger scale than is possible with the known device. This object is accomplished by the present invention in that said at least one mould comprises two mould halves which are movable relative to each other, so that the mould halves can be moved apart once the ice column has been formed. As a result, the ice column can be easily removed from the mould by moving said mould halves, which are movable relative to each other, away from the ice column. Especially if the mould comprises heating means for detaching the ice column from the mould halves by melting, ice can thus be removed from the mould very quickly and a next production cycle can be started.

A known device for making ice cubes comprises an elongated mould which extends horizontally and which is provided with ribs at the bottom side so as to provide a matrix for forming ice cubes. The supplying device comprises a spraying device, which sprays refrigerated water against the open bottom side of the mould, after which the water on the bottom side of the mould freezes. Thus an ice mass grows on the bottom side of the mould, which ice mass is divided into ice cubes by the ribs. The ice cubes are subsequently detached from the mould and packaged for storage and transport, for example to catering establishments.

A drawback of the known device is its limited production capacity, because the growth of the ice cubes takes place too slowly and only one layer of ice cubes can be made with each batch.

From US 2004/0093878 A1 there is known an ice making device which comprises two ice making sections provided with a column of ice making compartments, behind which cooling pipes extend. The ice making compartments are open at the front. Refrigerated water is sprayed into the compartment through the open front side via a spray hole, which water grows into an ice cube as a result of the refrigerating action of the cooling pipes at the rear side of the compartments. Also JP-10-197114 A and JP 2003-130513 A describe devices based on compartments which are open on one side, into which compartments water is sprayed.

In a preferred embodiment of the present invention, refrigerating means are provided having the liquid substance cooled and frozen by said at least one mould. As a result, the liquid substance is cooled and frozen directly in the mould, which leads to a relatively high output.

In a preferred embodiment of the present invention, said at least one mould comprises heating means for detaching the obtained ice column by melting.

In order to be able to produce more than one ice cube in each mould, it is preferable if said at least one mould defines a series of interconnected, hollow spaces for forming an elongated ice column of interconnected ice cubes. Since the ice cubes are interconnected in a way defined by the shape of the mould, they can be packaged and oriented in an efficient manner upon use. The interconnection between ice cubes can vary from a minimum connection to a connection over the entire area of the side-by-side surfaces, so that an elongated column is obtained, as it were, in which the individual ice cubes cannot be distinguished. In fact, ice cubes of variable length can be broken or cut off from such a column.

The mould may therefore have a continuous inner surface so as to produce a bar of ice that can subsequently be divided into separate ice cubes, but it is preferable if the mould comprises reduced diameter portions so as to form reduced diameter portions in the elongated ice column between adjacent ice cubes. As a result, it will be easier to separate individual ice cubes from each other upon subsequent use of the ice cubes than in the case of a continuous mould as described at the beginning of this paragraph.

In an alternative preferred embodiment of the present invention, said at least one mould defines a series of individual hollow spaces for forming an ice column of a plurality of individual ice cubes. The advantage of this is that the ice cubes need not be separated from each other at a later stage, at least if the ice cubes are prevented from freezing together yet during subsequent storage.

In a preferred embodiment of the present invention, agitation means are provided for agitating the liquid substance while it is being refrigerated in said at least one elongated mould. Said agitation means may comprise a vibration device which sets said at least one mould and possibly other parts of the device vibrating during the refrigeration process. The agitation means may also be (partially) located inside the mould, for example in the form of a stirrer or a bar-shaped element that moves inside the mould while the liquid substance is being refrigerated. The advantage of this is that a clear liquid will freeze as a clear ice cube. If no agitation of the liquid takes place, an opaque ice cube will be formed during the refrigeration process.

With a view to forming a cavity in the ice cubes it is preferable if an elongated element extends through said at least one mould in the longitudinal direction of said at least one mould, around which element the ice cubes are formed in the mould. It may be desirable to form cavities in ice cubes, for example in order to be able to manipulate the ice cubes at a later stage and/or enlarge the chilling area of the ice cubes. The elongated element may be an agitation element.

It is preferable in that regard if the elongated element comprises heating means. Said heating means, too, make it possible to detach the ice column quickly from the elongated element by melting, for example by first heating the mould, then moving the mould halves away from the column and subsequently heating the elongated element, so that the ice column can slide along the elongated element into a package. If the elongated element is provided with refrigerating means, it is moreover possible to refrigerate the water in the mould by means of said elongated element so as to freeze the water even more quickly.

Said at least one mould is preferably substantially vertically oriented. The advantage of this is that when the ice cubes are to be removed from the mould, for example by moving mould halves apart as described in the foregoing, the ice column or the individual ice cubes can fall straight down into a package, in the case in which an elongated element as discussed above is provided, said elongated element can function as a guide for the ice column or the ice cubes.

In order to further increase the capacity, it is preferable if the device comprises a row of moulds oriented side by side, whilst it is furthermore preferable if the device comprises a number of moulds which are oriented in a matrix relative to each other. In this way a relatively compact device is obtained for producing ice cubes at a high capacity.

It is furthermore preferable if conveying means are provided for positioning a container under said at least one mould for collecting ice cubes formed by the device. In this way the ice cubes can be packaged in a correct and efficient manner, while it is possible to mechanise and/or automate the production process, so that no human operations are required. This makes it possible to work not only efficiently but also hygienically.

It is furthermore preferable if pre-refrigerating means are provided for pre-refrigerating a liquid substance to be supplied to said at least one mould. In general if can be stated that the colder the liquid substance that is supplied to said at least one mould, the more quickly said liquid substance can be converted into ice by further refrigeration in the mould and the more quickly the production cycle can be completed. This, too, leads to increased capacity of the device.

The present invention, according to a second aspect thereof, relates to a method for making ice cubes, comprising the steps of supplying a liquid substance to a mould, freezing the liquid substance in the mould and removing the ice cubes thus formed from the mould. Such a method is known and has been described in the foregoing with reference to the known device for producing ice cubes. With the method according to the present invention, in order to accomplish the object of achieving a higher production capacity, the liquid substance is supplied in said first step to a mould comprising an at least substantially closed space. For preferred embodiments of the method according to the second aspect of the present invention, reference is made to the description of the device according to the first aspect of the present invention.

The present invention, according to a third aspect thereof, relates to a metering device for ice cubes, comprising a container for ice cubes and engaging means for engaging an ice cube and depositing it in a drinking container.

Such a device is known in the catering industry and comprises a storage container for ice cubes and a pair of tongs by means of which a barman can pick ice cubes from the storage container and subsequently deposit them in a glass. A drawback of such a device is that a barman can easily reach the contents of the storage container not only with the aforesaid tongs but also with his hand. Frequently, the tongs are left untouched in the storage container, if they are placed in the storage container at all, and the barman takes out the ice cubes with his hand. This is unhygienic, as is the fact that the ice cubes in the storage container are often continuously exposed to the ambient air in the bar. If a lid for the storage container is available at all, it is not used in most cases.

There are also devices in which ice cubes can be deposited into a glass from the storage container through a discharge opening fitted with a valve. With such a device it is difficult to meter the amount of ice, however. In addition to that there is a danger that the ice cubes will get jammed in front of or in the discharge opening and block the discharge opening.

Consequently it is an object of the present invention according to the third aspect thereof to provide a metering device for ice cubes in which the risk of unhygienic operation is minimal and by means of which an adequate metering action can be realised. This object is accomplished by the present invention in that metering means are provided for metering one or more ice cubes to be deposited into the drinking container by mechanical means. The term "mechanical" is understood to mean that the engaging means are mechanically operated, in contrast to the known device, in which the tongs are moved into the storage container by hand and squeezed together by hand for the purpose of gripping one or more ice cubes. With a device according to the third aspect of the invention, the storage container need not be accessible from outside for taking out ice cubes, but the ice cubes can simply be engaged within a closed container by mechanical engaging means and be guided to the drinking container via a discharge opening. In this way ice cubes can be prevented from being continuously exposed to the ambient air in the bar.

It is preferable in that regard if the metering means comprise an engaging element for engaging at least one ice cube. The use of the engaging element makes it easier to meter the amount of ice cubes to be deposited.

In a preferred embodiment of the present invention, the metering means comprise a finger for engaging in a cavity of at least one ice cube for guiding said at least one ice cube from said container in the direction of a drinking container. A cavity, for example a through hole, in an ice cube makes it relatively easy to orient and handle the ice cube.

In a preferred embodiment of the present invention, the metering means are arranged for separating one or more ice cubes from a column of interconnected ice cubes. The ice cubes in a column of ice cubes are oriented in a specific manner relative to each other. When an ice column according to a first aspect of the present invention is stored in the container, ice cubes can be deposited into the drinking container from said ice column in a simple and metered manner.

To vary the number of ice cubes to be deposited into a drinking container in dependence on circumstances such as the wishes of the owner of a catering establishment or the outside temperature, it is preferable if setting means are provided for setting the number of ice cubes to be deposited into a drinking container.

To be able to engage the ice cubes in a desired manner, it is preferable if the container is arranged for presenting the ice cubes in the container in a desired orientation to the metering means. This is for example possible by arranging the container so that a number of ice columns can be accommodated beside and/or behind each other in the container.

The present invention will be explained in more detail hereinafter with reference to the following figures, which show embodiments of devices according to the present invention.

Figure 1:
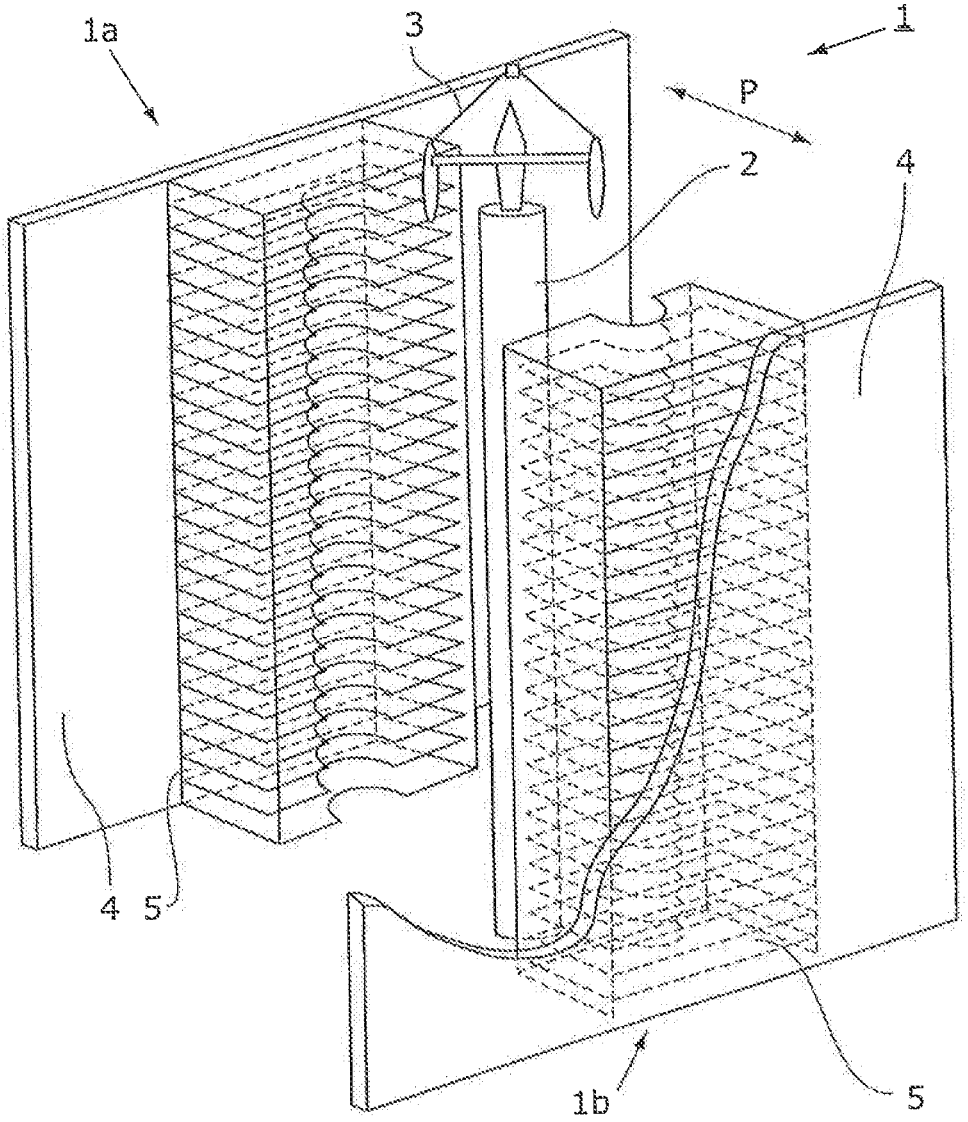
FIG. 1 is a schematic, perspective view of a mould for an ice column according to the present invention in an open condition thereof.

With reference to FIG. 1, there is shown a mould 1 for making ice cubes. The mould 1 comprises two mould halves 1*a*, 1*b*, which are movable relative to each other in the directions indicated by the arrow P, and a tube 2 with a suspension system 3. The mould halves 1*a*, 1*b* each comprise a plate 4 and a series of mould elements 5 arranged one above another.

Figure 2:
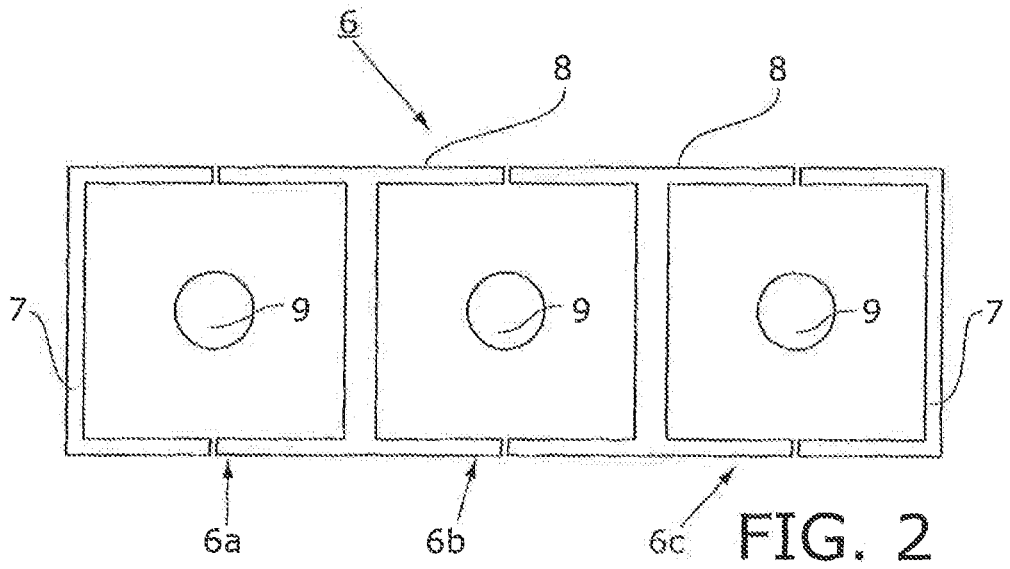
FIG. 2 is a schematic, cross-sectional view of the mould of FIG. 1 in closed position.

FIG. 2 is a cross-sectional view of an assembly 8 of three moulds 6*a*, 8*b*, 6*c* according to the principle of FIG. 1, which are made up of U-shaped sections 7 and H-shaped sections 8, through which tubes 9 extend.

Figure 3:
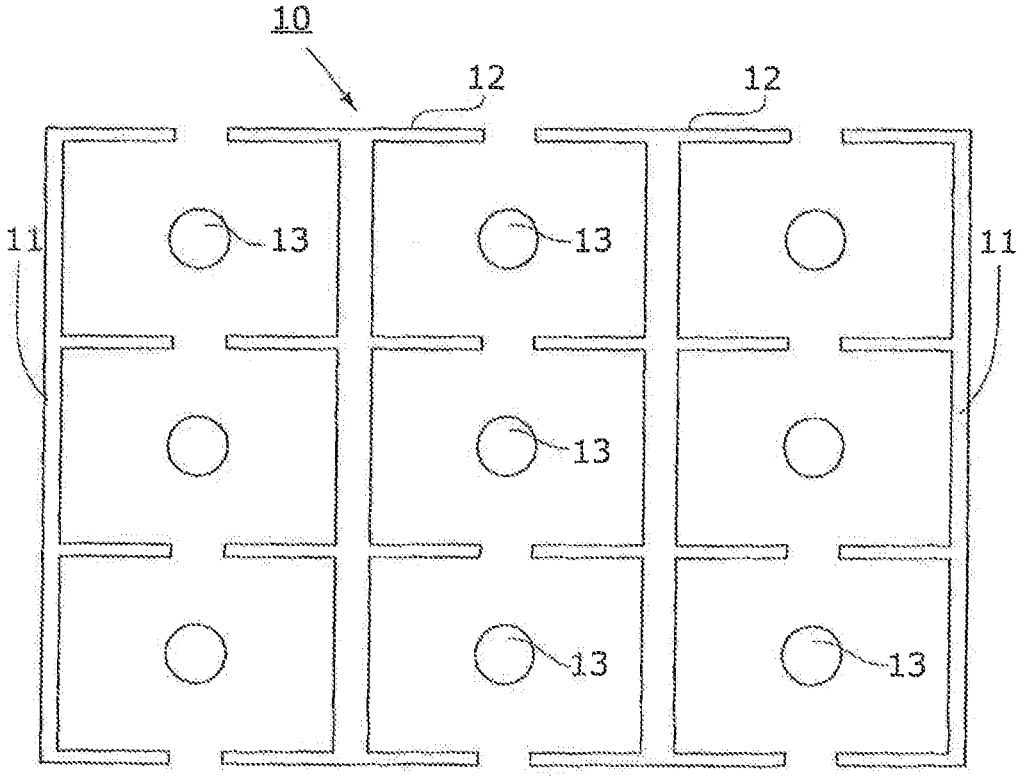
FIG. 3 is a schematic, cross-sectional view of a matrix of moulds in open condition.

FIG. 3 shows a matrix mould 10 comprising nine moulds according to the principle of FIG. 1, which are made up of section elements 11, 12, through which tubes 13 extend.

Figure 4:
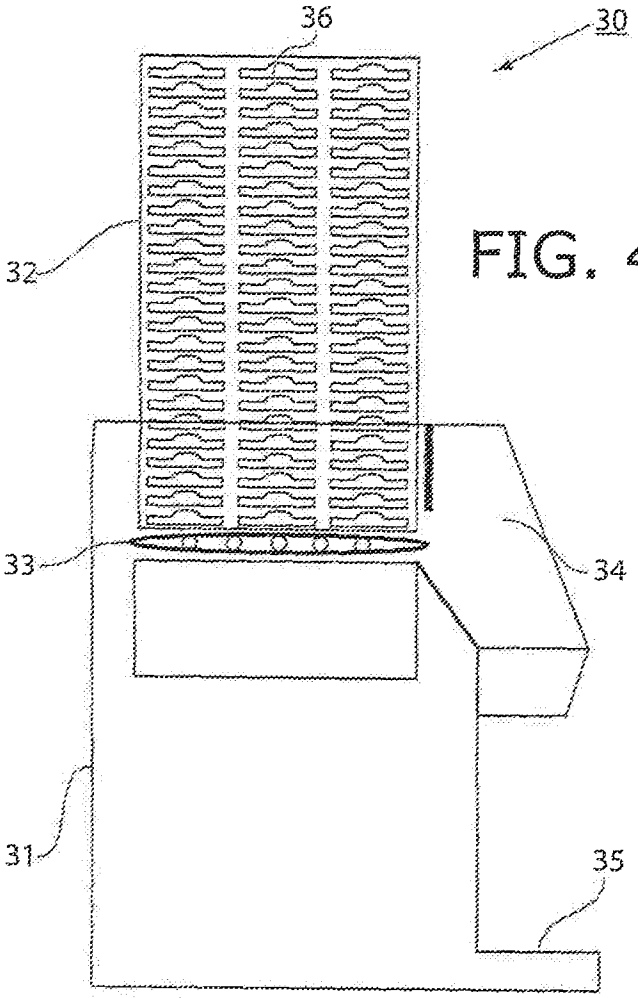
FIG. 4 is a schematic, sectional side view of an ice dispenser according to the present invention.

FIG. 4 is a schematic side view in longitudinal section of an ice dispenser 30 comprising a cabinet 31, in which a storage space 32 for ice cubes 38 comprising a conveyor 33 is present. The conveyor 33 extends up to an ejection opening 34, which opens above a platform 35.

Figure 5:
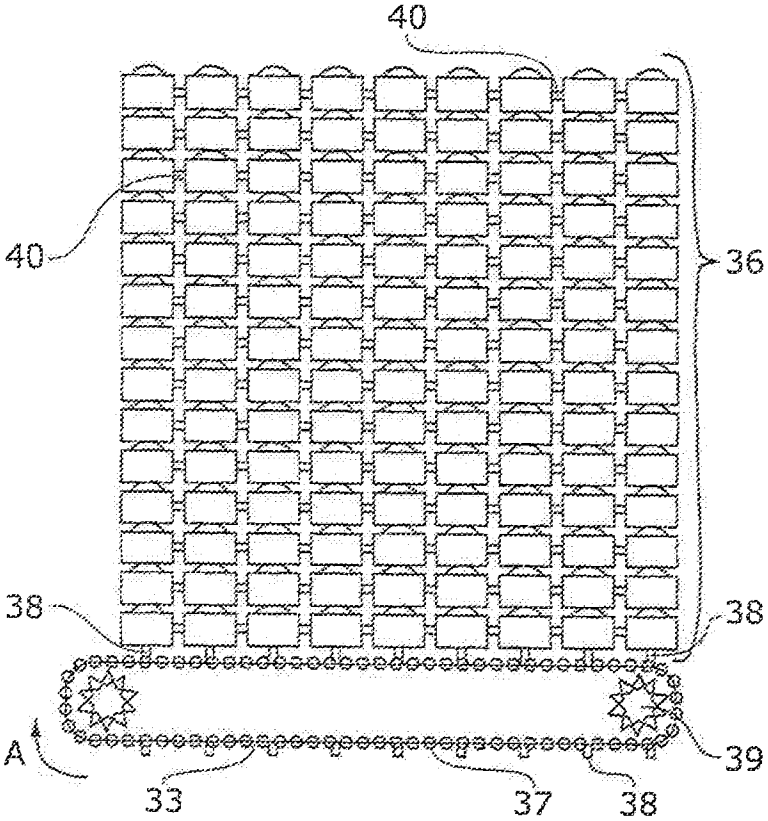
FIG. 5 is a side view of a conveyor for ice cubes in a dispenser according to the present invention.

FIG. 5 is a detail view of ice cubes 38 stored in the storage space 32 of FIG. 4, above a conveyor 33 comprising a chain 37 provided with fingers 38, which is passed over sprocket wheels 39, one of which sprocket wheels can be rotatably driven for driving the chain 37 in turn.

Referring now to FIG. 1, there is shown a mould 1 for making ice cubes. The mould 1 comprises two mould halves 1*a*, 1*b*, which are movable towards and away from each other in the directions indicated by the arrow P. In FIG. 1 the mould halves 1*a*, 1*b* are shown in a condition in which they are maximally apart. The mould halves 1*a*, 1*b* each comprise a plate 4, which is provided with mould elements 5 arranged one above another. In this example the mould elements 5 are rectangular in shape, provided with a semicircular recess so as to create space for the tube 2. In the position in which the mould halves 1*a*, 1*b* have been moved together (see FIG. 2), two opposing mould elements 5 form a space for an ice cube. The mould elements may be provided in such a manner as to be exchangeable, making it possible to use mould elements of varying shapes in the device according to the present invention. A tube 2, which is suspended from a suspension system 3, extends vertically between the two mould halves 1*a*, 1*b*.

FIG. 2 is a cross-sectional view of an assembly 6 of such moulds 6*a*, 6*b*, 6*c* according to the principle as explained with reference to FIG. 1. In FIG. 2 the moulds 8*a*, 8*b*, 6*c* are substantially closed, i.e. the mould halves have been moved together, thus forming one substantially closed space around respective tubes 9. In FIG. 2 the mould halves are made up of U-shaped sections 7 on the outer side and H-shaped sections 8 in the centre of the assembly 8. In this embodiment, the middle tube 9 remains stationary. The H-sections 8 can be moved aside, away from the middle lube 9, and the outer tubes 9 can in turn be moved in outward direction, further away from the H-sections 8. The U-sections 7 can be moved even further outwards with respect to the outer tubes 9. In this way sufficient space is created around all the tubes 9 for removing ice columns formed in the moulds 6*a*, 6*b*, 6*c*.

FIG. 3 shows a matrix mould 10 comprising moulds according to the principle of FIG. 1, with section elements 11 on the outer sides and section elements 12 in the centre of the matrix mould. The operating principle of the matrix mould 10 corresponds to that shown in FIG. 2. In FIG. 3 the section elements 11, 12 are shown in spaced-apart relationship, as in FIG. 1. As the figure shows, the spacing between the tubes is larger than in FIG. 2.

To produce ice columns by means of a matrix mould as shown in FIG. 3, the moulds are substantially closed by moving the section elements 11 and 12 together, i.e. the section elements to the left of the middle column of tubes 13 are moved to the right as much as possible and the section elements 11, 12 to the right of the middle column of tubes are moved to the left as much as possible. The tubes 9 remain oriented approximately centrally between the section elements. Subsequently, water having a temperature near the freezing point is introduced into the moulds from the upper side of each mould. The moulds are closed at the bottom side, so that the moulds will fill with water. Once sufficient water has been introduced into the moulds, the section elements 11, 12 are refrigerated in a manner which is known per se, causing the water present in the moulds to freeze. When ice columns have thus been formed in the moulds, the section elements 11, 12 are briefly heated, as a result of which the ice columns will melt at their circumference, where they make contact with the section elements 11, 12, and the section elements 11, 12 can be returned to the position shown in FIG. 3. The ice columns will remain in place, because they are frozen on to the tubes 13. Subsequently the tubes 13 are heated, so that the ice columns will melt at their inner circumference and become detached from the tubes 13. A container for the ice columns may be disposed under the moulds, so that the ice columns will fall directly into said container to be packaged for storage and transport. The section elements 11, 12 can then be moved together again and a next production cycle can start. In this way a relatively large amount of ice cubes is produced in a very efficient and relatively quick manner.

FIG. 4 is a schematic, sectional side view of a dispenser 30 for ice cubes 36. The ice dispenser 30 comprises a cabinet 31 for positioning the storage space 32 with the conveyor 33 at a height sufficient for having ice cubes 38 fall into a glass or the like placed on the platform 35 via an ejection opening 34. Located at the front side of the cabinet 31, i.e. the side at which the ejection opening 34 and the platform 35 are present, is a control panel (not shown) for an operator who can control the conveyor 33 via said panel for moving a desired number of ice cubes 36 to the ejection opening 34. The storage space 32 is preferably insulated and refrigerated so as to prevent ice cubes 38 melting in the storage cabinet.

The interior of the storage space 32 of FIG. 4 is shown in more detail in FIG. 5. As the figure shows, a chain 37 passed over sprocket wheels 39 is disposed under the columns of ice cubes 35. At least one of the two sprocket wheels 39 can be driven by an operator via the aforesaid control panel for delivering a desired number of ice cubes 38 via the ejection opening 34. The chain 37 has fingers 38, which are provided on the chain 37 with substantially the same spacing between them as the spacing between the central axes of the ice cubes 36. If the ice cubes 38 have for example been formed by means of a mould provided with a tube (2, 9, 30) as shown in FIGS. 1-3, the columns of ice cubes 36 will be hollow. On account of their profile, the ice cubes 38 within a column have melted together over a very limited surface area. In the example of FIG. 5, the ice cubes 36 have melted together in horizontal direction as well, forming bridge connections 40, so that one block of ice has been formed, as it were, with substantially vertical interspaces. Within the storage space 32, said block of see is held at a specific vertical distance above the fingers 38 on the upper side of the chain 37. When the storage space 32 is filled (again), the ice cubes 36 at the bottom side of the respective columns will be oriented in a horizontal plane above the fingers 38. Then the ice dispenser 30 is activated and the block of ice cubes 36 is lowered one step. As a result, the hollow spaces of the respective ice cubes 38 will slip over the fingers 38 on the upper side of the chain 37. Subsequently the chain is driven in the direction indicated by the arrows A towards the ejection opening 34, as a result of which the lowermost row of ice cubes will move to the right and an ice cube 36 will fall from a respective finger 38 on the right-hand side each time a finger 38 is moved from a vertically upward position to a vertical downward position via the sprocket wheel 39. Via the ejection opening 34, the ice cube 36 will fall info a glass (not shown) that has been placed on the platform 35. Once all the lowermost ice cubes (9 in this case) have been removed from the bottom side of the ice block by the chain 37 provided with fingers 38, the entire ice block will be lowered one step again, so that a new row of ice cubes 36 will slip over the fingers 38. The chain 37 may also be driven in such a manner that it is moved by a distance of two or more ice columns, as a result of which two or more ice cubes will be deposited into a glass via the ejection opening 34. According to another possibility, two or more ice cubes and two or more conveyors are disposed one behind another in the dispenser, so that the conveyors can be driven in parallel, for example, and two or more ice cubes can be delivered more quickly via the ejection opening 34.

Only a few embodiments of devices according to the present invention have been shown and described in the foregoing. It will be apparent, however, that neither the description nor the figures have a limitative effect on the scope of the present invention, which is defined by the appended claims. Thus it is possible, for example, to freeze another liquid or liquid substance in the mould instead of water. Think in this connection of a non-alcoholic or alcoholic beverage. In the latter case the freezing temperature will be lower than in the case of water or lemonade, but it is possible to make a drink with a shot of a well-metered amount of an alcoholic beverage by means of ice cubes. Furthermore, other substances such as puree, boiled and finely cut vegetables, to which a binding agent may or may not be added for liquefying the same, can be produced by using a device or the method according to the first two aspects of the invention.

In the case of the third aspect of the invention, a different orientation of the engaging means or of the ice cubes may be used, for example a horizontal orientation, or different means may be provided for separating the individual ice cubes. Furthermore, in order to make it possible to crush ice cubes, the discharge opening may be provided with a grate onto which the ice cubes fall and with knives that cut through the ice cubes on the grate and move them through the openings in the grate. Sufficiently crushed ice will subsequently fall through the grate.

The above description might give the impression that the invention is limited to cubic ice cubes, but also other shapes, for example cylindrical or oval shapes, are quite possible.

The invention claimed is:

1. A device for making frozen blocks of a frozen liquid column made by freezing a supplied liquid, the device comprising:

an elongated mold comprising a two-piece mold assembly comprising:

a first mold side, and a second mold side, wherein a frozen column space is formed, by bringing the first mold side and the second mold side together, that contains the supplied liquid during ice making; and an elongated element that extends longitudinally through the frozen column space formed by bringing the first mold side and the second side together;

wherein the first mold side is movable relative to the second mold side to enable releasing the frozen liquid column from the elongated mold, wherein the frozen column space comprises a linear series of interconnected spaces, wherein the frozen liquid column comprises a linear series of interconnected frozen blocks formed around the elongated element, wherein each individual one of the linear series of interconnected spaces corresponds to an individual one of the linear series of interconnected frozen blocks, and wherein the elongated element forms a cavity in each individual one of the linear series of interconnected frozen blocks of the frozen liquid column.

2. The device according to claim 1, wherein the elongated mold comprises a heater that supplies heat that aids in detaching the frozen liquid column from the elongated mold.

3. The device according to claim 1 further comprising an agitator that agitates the supplied liquid while the supplied liquid occupies the elongated mold.

4. The device according to claim 1, wherein the elongated element comprises a heater.

5. The device according to claim 1, comprising a plurality of ones of the elongated mold, with the plurality of ones of the elongated mold being oriented in a matrix of frozen liquid column spaces.

6. The device according to claim 1, further comprising a conveyor that positions a container under the elongated mold.

7. The device according to claim 2 further comprising an agitator that agitates the supplied liquid while the supplied liquid is being refrigerated in the elongated mold.

8. The device according to claim 1 further comprising an agitator that agitates the supplied liquid while the supplied liquid is being refrigerated in the elongated mold.

9. The device of claim 3, wherein the agitator comprises a vibrator that vibrates the elongated mold during freezing.

10. The device of claim 3, wherein the agitator comprises a stirrer that moves within the frozen column space formed within the elongated mold.

11. A method for making frozen blocks of a frozen liquid column made by freezing a supplied liquid contained in, the method comprising:

supplying the supplied liquid to an elongated mold comprising a two-piece mold assembly comprising:

a first mold side, and a second mold side, wherein a frozen column space is formed, by bringing the first mold side and the second mold side together, that contains the supplied liquid during ice making freezing the supplied liquid contained within the elongated mold after the supplying the liquid substance, moving, after the freezing, the first mold side relative to the second mold side to enable a releasing of the frozen liquid column from the elongated mold;

wherein the elongated mold comprises a series of interconnected spaces, wherein an elongated element extends longitudinally; through the frozen column space formed by bringing the first mold side and the second mold side together, wherein the frozen column comprises a linear series of interconnected spaces, wherein the frozen liquid column comprises a linear series of interconnected frozen blocks formed around the elongated element, wherein each individual one of the linear series of interconnected spaces corresponds to an individual one of the linear series of interconnected frozen blocks, and wherein the elongated element forms a cavity in the frozen liquid column;

freezing the liquid substance in the elongated mold.

12. The method of claim 11 further comprising agitating the supplied liquid during the freezing.

13. The method of claim 12, wherein the agitating comprises vibrating the elongated mold during the freezing.

14. The method of claim 12, wherein the agitating comprises moving, during the freezing, a stirrer within the frozen column space formed within the elongated mold.

* * * * *